US006469265B1

(12) United States Patent
Penix et al.

(10) Patent No.: US 6,469,265 B1
(45) Date of Patent: Oct. 22, 2002

(54) METHOD AND APPARATUS FOR A LIMIT SWITCH

(75) Inventors: William J. Penix, Alger; Matthew J Westrick, St. Charles; Scott A Born, Saginaw; Michael H Appold, Bay City, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/874,608

(22) Filed: Jun. 5, 2001

(51) Int. Cl.[7] ..... H01H 9/26; H01H 3/16

(52) U.S. Cl. ..... 200/50.32; 200/47; 200/1 R; 200/16 A; 200/334

(58) Field of Search ..... 200/47, 50.32, 200/1 R, 51 LM, 61.41, 61.42, 16 R, 16 A, 16 B, 16 C, 573, 334

(56) References Cited

U.S. PATENT DOCUMENTS 4,943,715 A * 7/1990 Konishi ..... 200/47
5,028,748 A * 7/1991 Sakamoto ..... 200/47
5,373,122 A * 12/1994 Henry ..... 200/61.42
5,552,570 A * 9/1996 Shinohara et al. ..... 200/47

* cited by examiner

*Primary Examiner*—Michael Friedhofer
(74) *Attorney, Agent, or Firm*—Edmond P. Anderson

(57) ABSTRACT

A limit switch includes a housing, a plunger, an actuator, a prime contactor, a redundant prime contactor, an adjustment contactor, and a redundant adjustment contactor disposed within the housing. The prime contactor and adjustment contactor are electrically coupled in series. The prime and redundant prime contactors are openable by the plunger, and the adjustment and redundant adjustment contactors are closable by the plunger. The redundant adjustment contact is electrically coupled in series with the redundant prime contactor. The limit switch controls a circuit by aligning the limit switch in a mid-position alignment. Opening the prime contactor or redundant prime contactor de-energizes the electrical circuit. Closing the prime contactor and the redundant prime contactor while the adjustment contactor and the redundant adjustment contactor are maintained closed energizes the electrical circuit. Opening the adjustment contactor or redundant adjustment contactor when the actuator is misaligned from the plunger de-energizes the electrical circuit.

25 Claims, 2 Drawing Sheets

METHOD AND APPARATUS FOR A LIMIT SWITCH

BACKGROUND

In electromechanical systems, switches provide the function of making and breaking electrical contacts and consequently electrical circuits. In certain system applications, there is a need to employ a switch that is capable of breaking and making electrical contact in circuits that control and/or power equipment. The equipment is desired to have an automatic electrical disconnect installed into the operating circuitry so that upon the occurrence of a selected condition, the circuit can be de-energized.

One type of switch is a limit switch which is a device that serves the function of connecting and disconnecting circuits in a fashion that is related to a given set of inputs. The inputs typically are mechanically derived positions that are linked to the device that is being protected by the limit switch. For example, when a device has reached a point of travel in a particular direction, the limit switch is activated to disconnect the electrical circuit usually stopping the mechanical motion of the device. In this fashion the limit switch limits the degree of travel or motion of the device and so can protect the device.

If a spring is broken in such a switch and no longer provides a bias, then contacts will not be opened upon actuation. Additionally if the contacts become welded perhaps from arcing across the contacts in the circuit, the spring bias may not be capable of opening the contacts. The circuit will remain energized even though the limit switch has been positioned to release the contacts. A spring failure or a stuck contact will prevent the contacts from opening. Damage to the equipment may result.

SUMMARY

Electrical circuits are controllable in electromechanical systems through limit switches. Limit switches can open and close electrical circuits to protect equipment. A limit switch is disclosed comprising a housing, a prime contactor and an adjustment contactor disposed within the housing. The prime contactor and the adjustment contactor are electrically coupled in series. A plunger is disposed in the housing. The prime contactor is openable by the plunger, and the adjustment contactor is closable by the plunger. A redundant prime contactor and a redundant adjustment contactor are also disposed within the housing. The redundant adjustment contactor is electrically coupled in series with the redundant prime contactor. The redundant prime contactor is openable by the plunger, and the redundant adjustment contactor is closable by the plunger. An actuator is in operable communication with the plunger.

A method of controlling a circuit with a limit switch is disclosed comprising aligning the limit switch in a mid-position alignment. The circuit is controlled with the limit switch by actuating the limit switch by direct acting contact by a plunger against a prime contactor. Opening the prime contactor, or opening the redundant prime contactor, de-energizes the electrical circuit of the limit switch. Closing the prime contactor along with the redundant prime contactor while the adjustment contactor and the redundant adjustment contactor is maintained closed, can be done to energize the electrical circuit. Opening the adjustment contactor or the redundant adjustment contactor when an actuator is misaligned from the plunger can be completed to de-energize the electrical circuit.

The above described and other features and advantages of the invention will be appreciated and understood by those skilled in the art from the following detailed description, drawings, and claims.

BRIEF DESCRIPTION OF THE DRAWINGS

Referring now to the figures, wherein like elements are numbered alike.

DESCRIPTION OF THE PREFERRED EMBODIMENT

Figure 1:
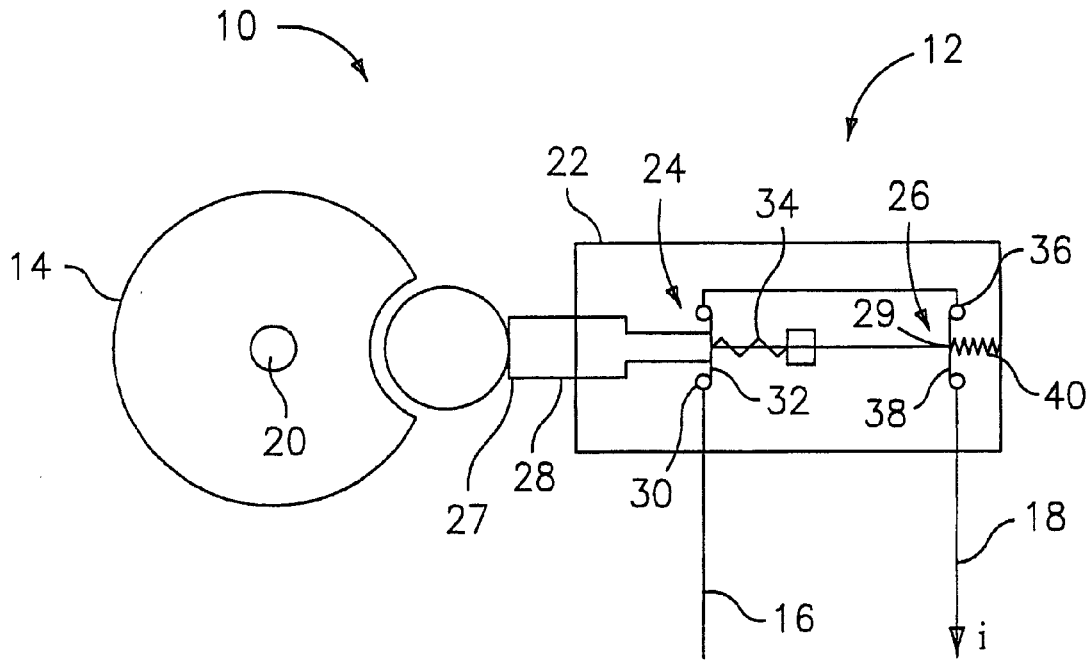
FIG. 1 is a schematic diagram of an. exemplary embodiment of a limit switch with all contacts closed.

Referring to FIG. 1, an exemplary embodiment of a limit switch 10 is shown. The limit switch 10 generally includes a switch 12 and an actuator 14 mechanically coupled. in order that upon movement of the actuator 14, the switch 12 moves and changes the state of an electrical circuit 16. In other words, through movement of actuator 14 the switch 12 can make or break the electrical circuit 16 allowing an electrical current 18 to flow or shutting off the electrical current 18.

The actuator 14 can be a cam mechanism or similar lobe that translates rotary motion to linear translation or movement. It will be appreciated that the actuator is not limited to transferring rotary motion to linear motion but the actuator can also transfer linear motion to linear motion. In one embodiment, the actuator 14 is a cam that acts with the switch 12. The cam rotates about a shaft 20. A handle or a guard (not shown) can be attached to the shaft 20 so that an operator can rotate the handle or actuate the guard and subsequently rotate the actuator 14 about the shaft 20.

The switch 12 includes a housing 22, which preferably contains and protects the subcomponents of the switch 12. Contained within the housing 22 is a part of the electrical circuit 16 that performs the switching function of making and breaking the electrical circuit 16. As part of the electrical circuit 16 two contacts (or contactors) are employed to perform the switching function; these are a prime contactor 24 and an adjustment contactor 26. In another embodiment, an additional set of redundant contactors in an additional circuit is employed in parallel with the prime contactor 24 and adjustment contactor 26 of electrical circuit 16. The electrical circuit 16 is equipped with two contactors having the functions of direct-action breaking and misadjustment detection. Further detail is described with reference to FIG. 4 below.

As shown in FIG. 1, the prime contactor 24 is the primary component in the switch 12 for making and breaking the electrical circuit 16. It is the primary component because the prime contactor is physically moved in normal operation to make contact and break contact. The adjustment contactor 26 acts to break the electrical circuit when the limit switch 10 is misadjusted or misaligned. The adjustment contactor 26 remains closed or in contact to complete the electrical circuit 16 during normal operation.

A plunger 28 is disposed in the housing 22 to facilitate the mechanical aspect of the switching function. In one embodiment, the plunger 28 comprises a shaft having two ends, a first end 27 and a second end 29 with the first end 27 being proximate to the actuator 14 and the second end 29 being distal from the actuator 14. The plunger 28 can be coupled to the housing 22 such that motion of the actuator 14 is transferred to the plunger 28 to facilitate the switching function of the switch 12. The plunger 28 extends outside of the housing 22 where the plunger 28 is in operable communication with the actuator 14. The plunger 28 supports the prime contactor 24, as well as moves it in and out of electrical connection with the electrical circuit 16.

In normal operation of the switch 12, the prime contactor 24 opens and closes (breaks electrical connection, makes electrical connection) upon actuation of the plunger 28 in the switch 12. In one embodiment, the prime contactor 24 has two prime contact points 30 and one prime contact plate 32. It is appreciated that more than two prime contact points 30 and more than one prime contact plate 32 can be utilized to conduct the electrical current 18 through the electrical circuit 16. The prime contact plate 38 is a platen shape but any configuration can be employed to conduct the electrical current 18 through the electrical circuit 16. The prime contact plate 32 is mounted on the plunger 28 such that movement of the plunger 28 translates into movement of the prime contact plate 32. The plunger 28 and the prime contact plate 32 move in a linear fashion in one embodiment.

A prime spring 34 is coupled to the plunger 28 and the prime contact plate 32. The prime spring 34 provides a spring bias (or spring force) that acts on the plunger 28 and the prime contact plate 32. The prime spring 34 closes the prime contact plate 32 against the prime contact points 30, upon some condition when the plunger 28 is no longer driven against the prime spring 34. Thereby the prime contactor 24 makes or completes the electrical circuit 16. The prime contactor 24 breaks the electrical circuit 16 upon some condition when the actuator 14 drives the plunger 28 against the force of the prime spring 34 to move the prime contact plate 32 disconnecting the prime contact plate 32 from the prime contact points 30.

FIG. 1 shows adjustment contactor 26. Adjustment contactor includes a number of adjustment contact points 36 and an adjustment contact plate 38. In one embodiment, the adjustment contactor 26 has two adjustment contact points 36 and one adjustment contact plate 38. It is appreciated that more than two adjustment contact points 36 and more than one adjustment contact plate 38 can be utilized to conduct the electrical current 18 through the electrical circuit 16. The adjustment contact plate 38 is a platen shape but any configuration can be employed to conduct the electrical current 18 through the electrical circuit 16. The adjustment contact plate 38 is coupled to an adjustment spring 40. The adjustment spring 40 is coupled to the housing 22. It is contemplated that the adjustment spring 40 can be coupled to other elements in order to provide a spring bias means to the adjustment contact plate 38. The adjustment contact plate 38 is normally in contact with the adjustment contact points 36 in normal operation of the switch 12. The plunger 28 forces the adjustment contact plate 38 against the adjustment contact points 36 in opposition to the bias of the adjustment spring 40. When the plunger 28 is disconnected from the actuator 14 or is overcome by the adjustment spring bias, allowing the adjustment spring bias to move the plunger 28 and the adjustment contact plate 38, the adjustment contact plate 38 disconnects from the adjustment contact points 36. Thereby the adjustment contactor 26 opens or breaks the electrical circuit 16.

Referring to FIG. 1, another aspect of the limit switch 10 is the mid-travel position window. The mid-travel position window can be understood as the configuration of the limit switch 10 when the actuator 14 holds or positions the plunger 28 in a mid-stroke. The plunger in a full stroke can be seen in FIG. 2. The mid-stroke position has the prime contactor 24 in a closed position and the adjustment contactor 26 in a closed position thereby energizing the electrical circuit 16. In the mid-stroke position, the limit switch 10 conducts current 18. The degree of travel or stroke length of the plunger 28 in relationship to the contacts is known as a mid-travel position window. In one embodiment, the mid-travel position window of the limit switch 10 is about three millimeters. The mid-travel position window can also be characterized as the amount of contact overlap between the prime contactor 24 and the adjustment contactor 26. The contact overlap allows the switch 12 to be adjusted so that normally open contacts close while keeping the normally closed contacts closed. By keeping the window relatively large and maintaining the switch 12 adjusted in a mid-stroke or partial actuation position the limit switch 10 can be difficult to render inoperable when tampered with (e.g. attempting to bypass the switch). In embodiments that employ a guard (not shown) with the actuator 14, the mid-travel position allows for detection of the guard being actuated, as well as the removal of the guard or misalignment of the switch 12. Fully actuating the switch 12 by tripping the guard or misadjusting the switch causes forced, direct-action opening of the prime contactor 24. Releasing the switch 12 by removing the guard or misadjusting the switch 12 causes the adjustment contactor 26 to open.

Figure 2:
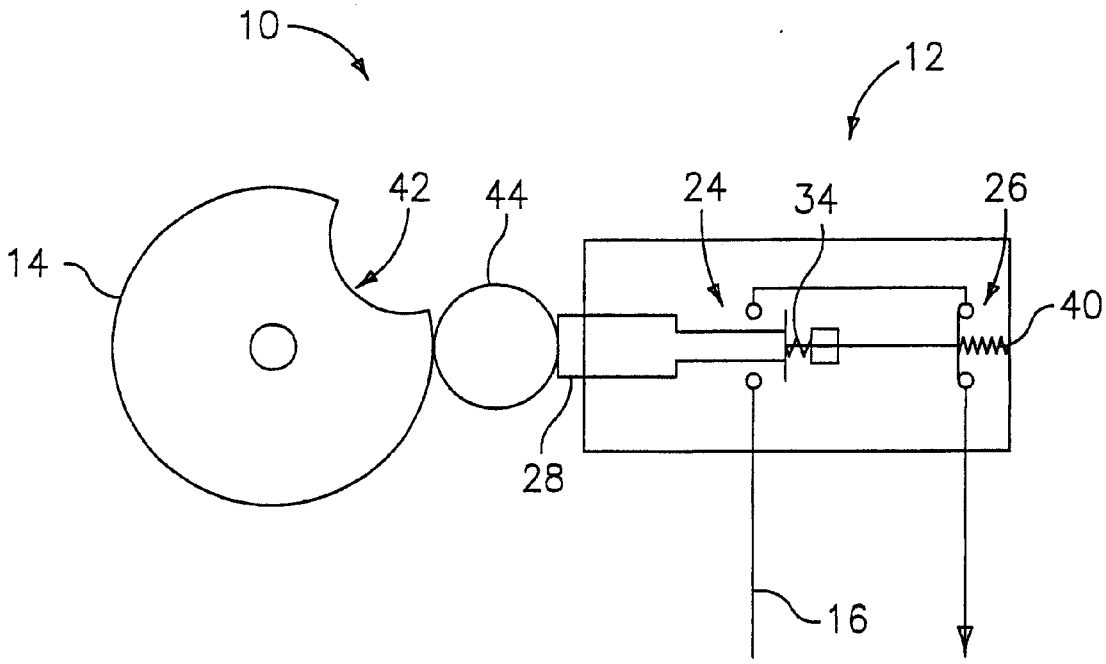
FIG. 2 is schematic diagram of an exemplary embodiment of a limit switch with a prime contactor open.
Figure 3:
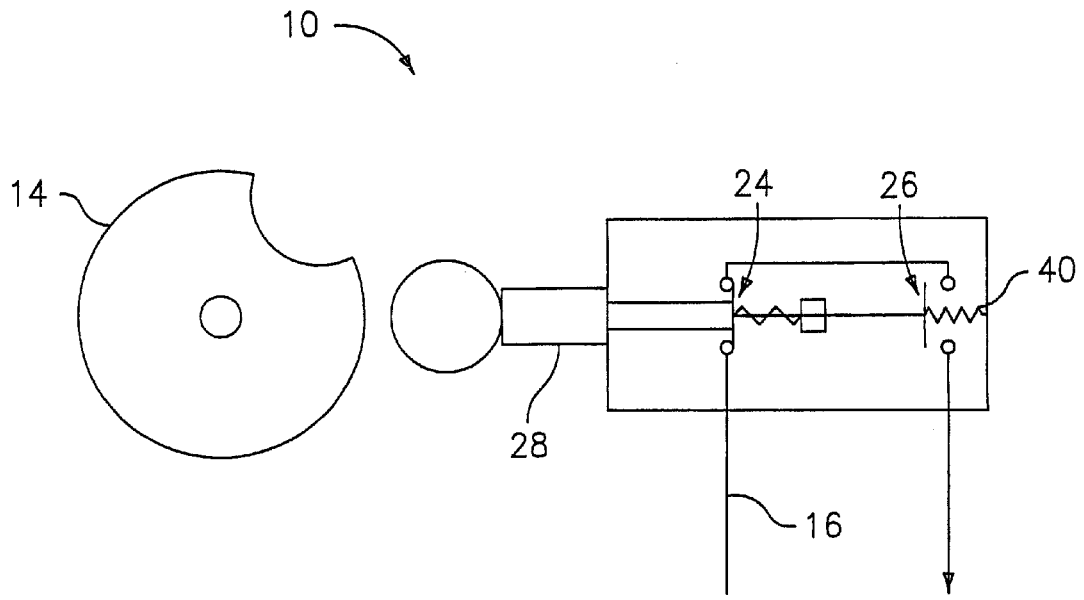
FIG. 3 is a schematic diagram of an exemplary embodiment of a limit switch with a adjustment contactor open.

The limit switch 10 can be understood by further describing the functions of the subcomponents with reference to FIGS. 2 and 3. FIG. 2 shows the limit switch 10 in a normal de-energized configuration with the prime contactor 24 open. The actuator 14 is shown adjusted to a position that drives or pushes the plunger 28. The plunger 28 has an actuator interface 44 disposed at the first end 27. The actuator 14 has a plunger interface 42 proximate to the plunger 28. In one embodiment, the plunger interface 42 is arranged to receive the actuator interface 44 in a nestable fashion as shown in FIG. 1. The actuator 14, in one embodiment, actuates to drive the plunger 28 upon a cam motion or rotation as shown in FIG. 2. The actuator interface is a roller rotatably mounted on the plunger 28 or any means for promoting a transfer of rotary or linear motion of the actuator 14 into a linear motion of the plunger 28. In the embodiment shown, the actuator 14 rotates and drives the plunger 28 against the spring force or bias of the prime spring 34 thereby compressing the prime spring 34. It can be appreciated that the prime spring 34 can be configured in another embodiment, so that the plunger 28 forced against the prime spring 34 extends the prime spring 34 instead of compressing it.

In any configuration, the bias of the prime spring 34 acts to push or drive the prime contactor 24 closed. The actuator 14 drives the plunger 28 to open the prime contactor 24. This configuration of having the actuator positively drive the prime contactor 24 open is also known as direct-acting contacts. Direct-acting contacts are mechanically forced open as the switch 14 is actuated. Mechanical failure of the prime contactor 24 subcomponents, (e.g., through contact weld), can be protected against by the mechanical opening of the prime contactor 24.

In the normal open configuration of limit switch 10, the adjustment contactor 26 is normally closed. To maintain the adjustment contactor 26 closed, the plunger 28 drives against the force or bias of the adjustment spring 40. The adjustment contact plate 38 is pushed into electrical connection with the adjustment contact points 36 (also shown in FIG. 1). The electrical circuit 16 is in a de-energized state even though the adjustment contactor 26 is closed because the prime contactor 24 is open.

Referring now to FIG. 3, a limit switch 10 is shown in an off-normal state or abnormal configuration with the adjustment contactor 26 open. The actuator 14 is shown dislodged from a normal position such as shown in FIG. 1 and FIG. 2. The actuator 14 is out of contact with the plunger 28. In this configuration, the plunger 28 overcomes the force that is applied against the adjustment spring 40 so that the adjustment contactor 26 opens, de-energizing the electrical circuit 16. This configuration is an example of the misalignment detection that is embodied in the limit switch 10. In the event of a failure of the actuator 14 and resultant release of the plunger 28 from the adjustment contactor 26 the limit switch 10 defaults into a de-energized condition. FIG. 3 illustrates a condition where the actuator 14 may be broken or may be removed or any other off-normal condition that creates a potential event for the device that the limit switch 10 is installed to protect. Even though the plunger 28 has allowed the primary contact 24 to close, the adjustment contactor 26 opens and maintains the electrical circuit 16 de-energized.

Figure 4:
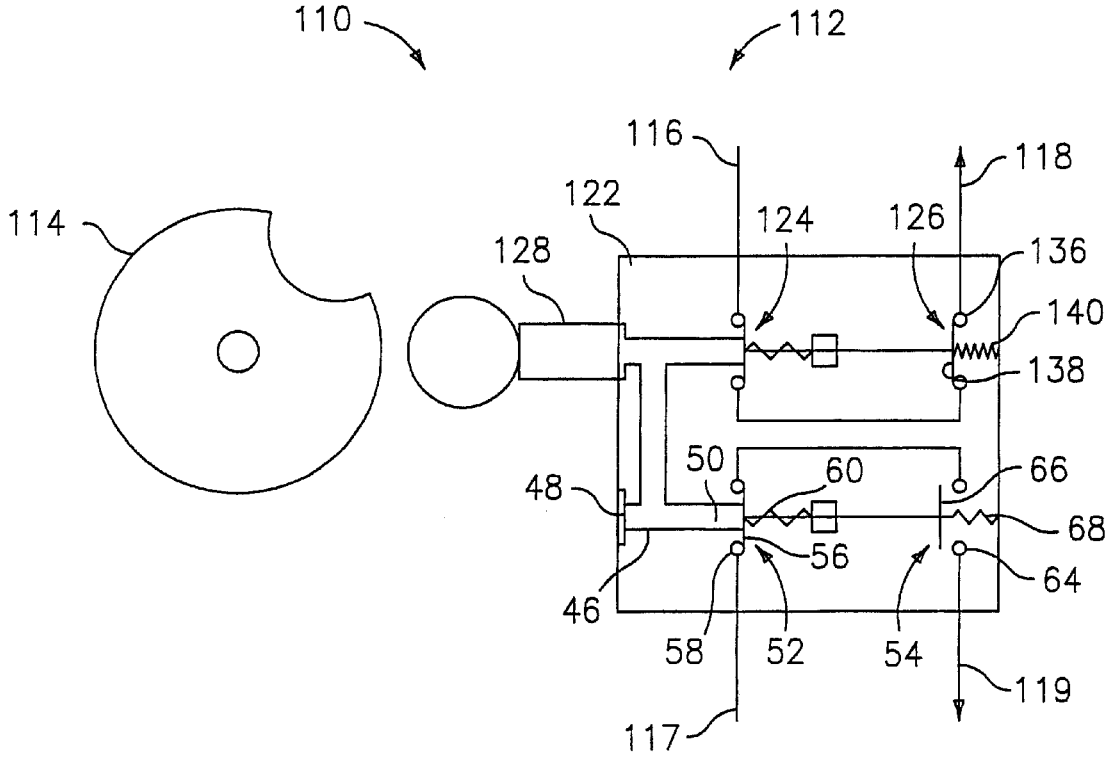
FIG. 4 is a schematic diagram of an exemplary embodiment of a limit switch.

Referring to FIG. 4 an exemplary embodiment of the limit switch 110 is shown equipped with redundant circuits and redundant sets of contactors. The limit switch 110 has redundancy in order to allow the limit switch 110 to function in the event of a failure of the any one of the contactors. The redundant components function similarly to their counter parts of the limit switch 10.

Limit switch 110 is equipped with a redundant plunger 46 coupled to the plunger 128. It is contemplated that a single plunger can be employed instead of two plungers. The redundant plunger 46 is mounted in the housing 122. Plunger 128 drives redundant plunger 46. Redundant plunger 46 comprises a shaft having two ends, a first end 48 and a second end 50. Redundant plunger 46 is connected to plunger 128 near the first end 48. Redundant plunger 46 is mounted such that motion of the plunger 128 is transferred to the redundant plunger 46 to facilitate the switching function. Redundant plunger 46 supports a redundant prime contactor 52. Redundant plunger moves redundant prime contactor in and out of electrical connection with the redundant electrical circuit 117.

In addition to the electrical circuit 116, as well as to the prime contactor 124 and the adjustment contactor 126, a redundant electrical circuit 117 having a redundant prime contactor 52 and a redundant adjustment contactor 54 are employed to perform the redundant switching function. The redundant prime contactor 52 duplicates the action of the prime contactor 124. The redundant adjustment contactor 54 duplicates the action of the adjustment contactor 126. In normal operation of the switch 112, the prime contactor 124 and redundant contactor 52 opens and closes upon actuation of the plunger 128 and redundant plunger 46.

The redundant prime contactor 52 similarly to the prime contactor 124 is provided with a redundant prime contact plate 56 and redundant prime contact points 58. The embodiment shown in FIG. 4 has one redundant prime contact plate 56 and two redundant prime contact points 58. It is contemplated that any number of redundant prime contact plates 56 and redundant prime contact points 58 can be employed. The redundant prime contact plate 56 makes electrical connection with the redundant prime contact points 58 to provide electrical conductivity for redundant electrical circuit 117. Redundant prime contact plate 56 is coupled to the redundant plunger 46 such that movement of the redundant plunger 46 translates into movement of the redundant prime contact plate 56 relative the redundant prime contact points 58.

A redundant prime spring 60 is coupled to the redundant plunger 46 and the redundant prime contact plate 56. The redundant prime spring 60 provides a spring bias that acts on the redundant plunger 46 and the redundant prime contact plate 56. The redundant prime spring 60 closes the redundant prime contact plate 56 against the redundant prime contact points 58 upon some condition when the redundant plunger 46 is no longer driven against the redundant prime spring 60. Thereby the redundant prime contactor 52 completes the redundant electrical circuit 117. It is also contemplated that the redundant prime contact plate 56 and the prime contact plate 124 are the same plate with electrical insulation separating the electrical circuits 116 and 117. The contact plates 124 and 56 can be in operable communication with each other, such that plunger 128 can be driven to open the electrical circuits 116 and 117.

FIG. 4 shows redundant adjustment contactor 54. In one embodiment, the redundant adjustment contactor 54 has two redundant adjustment contact points 64 and one redundant adjustment contact plate 66. It is appreciated that more than two redundant adjustment contact points 64 and more than one redundant adjustment contact plate 66 can be utilized to conduct the electrical current 119 through the redundant electrical circuit 117. The redundant adjustment contact plate 66 is a platen shape but any configuration can be employed to conduct the electrical current 119 through the redundant electrical circuit 117. The redundant adjustment contact plate 66 is coupled to a redundant adjustment spring 68. The redundant adjustment spring 68 is coupled to the housing 122. It is contemplated that the redundant adjustment spring 68 can be coupled to other elements in order to provide a spring bias means to the redundant adjustment contact plate 66. The redundant adjustment contact plate 66 is normally in contact with the redundant adjustment contact points 64 in normal operation of the switch 112. The redundant plunger 46 forces the redundant adjustment contact plate 66 against the redundant adjustment contact points 64 in opposition to the bias of the redundant adjustment spring 68. When the plunger 128 is disconnected from the actuator 114 or is overcome by spring bias, allowing spring bias to move the plunger 128 and the redundant plunger 46, the redundant adjustment contact plate 66 disconnects from the redundant adjustment contact points 64. Thereby the redundant adjustment contactor 54 opens or breaks the redundant electrical circuit 117.

As shown in FIG. 4, the limit switch 110 is in an off-normal condition with both the prime contactor 124 and the adjustment contactor 126 closed. The actuator 114 is shown dislodged from a normal position such that the plunger 128 is dislodged from applying a force on the adjustment contactor 126. The prime contactor 124 is closed and the adjustment contactor 126 is closed thereby potentially energizing the electrical circuit 116. In this configuration a condition can exist in which the actuator 114 is disabled and the electrical circuit 116 is energized. As seen in FIG. 3, even though the actuator 14 is disabled, the limit switch 10 would maintain the electrical circuit 16 de-energized due to the adjustment contactor 26 being open and thereby de-energizing the electrical circuit 16. However, FIG. 4 illustrates a condition where the adjustment contactor 126 has become stuck or failed closed. The adjustment contact plate 138 can weld to the adjustment contact points 136 due to arcing. The adjustment spring 140 can fail to provide a spring bias. The result of the failure of the adjustment contactor 126 to open is that the electrical circuit 116 can potentially remain energized when operators may expect it to be de-energized. The redundant set of contactors, 52 and 54 provides the additional set of contactors to maintain the redundant electrical circuit 117 de-energized. In this condition, the off-normal condition is detectable by monitoring the redundant set of contacts, redundant prime contactor 52 and redundant adjustment contactor 54. The redundant adjustment contactor 54 will open upon the failed actuator 114 and de-energize the redundant electrical circuit 117. The electrical circuit 116 and the redundant electrical circuit 117 can be wired to a safety circuit not shown such that upon failure of the contactors in electrical circuit 116, redundant electrical circuit 117 will maintain the device in a de-energized condition. The failed adjustment contactor 126 can then be detected upon inspection of the limit switch 110. Because the limit switch 110 is maintained in a mid-travel position, damaged, misadjusted, or removed actuators 114 can be detected.

An additional circuit can have detection logic and components that detect the position of the contactors and provide indication based on the contactors position. Control circuitry can also be wired to include controlling the device that the limit switch 110 is equipped to protect.

The limit switch 110 is more usable due to the larger range of the mid-travel position window. The limit switch 110 has redundant contacts in electrical series that allow for use of the limit switch 110 to be used in safety circuits requiring monitored redundancy, as well as circuits where monitoring and/or redundancy is not required. The prime contactor 124 can be opened by direct action and the adjustment contactor 126 can be opened by spring action. On a failure of the limit switch 110 the failure mode is open, thus maintaining the circuit de-energized.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A limit switch comprising:

a housing;

a prime contactor disposed within said housing;

an adjustment contactor disposed within said housing electrically coupled in series with said prime contactor;

a plunger disposed in said housing, said prime contactor being openable by said plunger, and said adjustment contactor being closable by said plunger;

a redundant prime contactor disposed within said housing;

a redundant adjustment contactor disposed within said housing electrically coupled in series with said redundant prime contactor; said redundant prime contactor being openable by said plunger, and said redundant adjustment contactor being closable by said plunger; and an actuator in operable communication with said plunger.

2. The limit switch as in claim 1, wherein said prime contactor, being opened by said plunger, breaks an electrical circuit electrically coupled to said prime contactor; and said redundant prime contactor, being opened by said plunger, breaks a redundant electrical circuit electrically coupled to said redundant prime contactor.

3. The limit switch as in claim 2, wherein said prime contactor is biased closed by a prime spring, said adjustment contactor is biased open by an adjustment spring, said redundant prime contactor is biased closed by a redundant prime spring, and said redundant adjustment contactor is biased open by a redundant adjustment spring.

4. The limit switch as in claim 3, wherein said prime contactor includes prime contact points electrically coupled to said electrical circuit and a prime contact plate coupled to said prime spring, and connectable with said prime contact points, said prime contact plate being movably disposed on said plunger, said redundant prime contactor includes redundant prime contact points electrically coupled to said redundant electrical circuit and a redundant prime contact plate coupled to said redundant prime spring, and connectable with said redundant prime contact points, said redundant prime contact plate being movably disposed on said plunger.

5. The limit switch as in claim 4, wherein said prime contactor closes by said prime contact plate making electrical connection with said prime contact points, and said prime contactor opens by said prime contact plate breaking electrical connection with said prime contact points, and said redundant prime contactor closes by said redundant prime contact plate making electrical connection with said redundant prime contact points, and said redundant prime contactor opens by said redundant prime contact plate breaking electrical connection with said redundant prime contact points.

6. The limit switch as in claim 2, wherein said adjustment contactor includes adjustment contact points electrically coupled to said electrical circuit and an adjustment contact plate coupled to said adjustment spring and said adjustment contact plate being connectable with said adjustment contact points, said redundant adjustment contactor includes redundant adjustment contact points electrically coupled to said redundant electrical circuit and a redundant adjustment contact plate coupled to said redundant adjustment spring and said redundant adjustment contact plate being connectable with said redundant adjustment contact points.

7. The limit switch as in claim 5, wherein said adjustment contactor closes by said adjustment contact plate making electrical connection with said adjustment contact points, and said adjustment contactor opens by said adjustment contact plate breaking electrical connection with said adjustment contact points, and said redundant adjustment contactor closes by said redundant adjustment contact plate making electrical connection with said redundant adjustment contact points, and said redundant adjustment contactor opens by said redundant adjustment contact plate breaking electrical connection with said redundant adjustment contact points.

8. The limit switch as in claim 1 wherein, said actuator is in operable communication with said plunger distal from said prime contactor.

9. The limit switch as in claim 8 wherein said adjustment contactor and said redundant adjustment contactor opens when said actuator is misaligned from said plunger.

10. The limit switch as in claim 8 wherein said actuator transfers a direct action force to said plunger, and said plunger reacts to drive open said prime contactor and said redundant prime contactor.

11. The limit switch as in claim 10 wherein said actuator includes a cam.

12. The limit switch as in claim 8 wherein said actuator aligns said plunger in a mid-travel position.

13. The limit switch as in claim 8 wherein said actuator and said plunger have a mid-travel position window of about three millimeters.

14. The limit switch as in claim 1 further comprising:

a redundant plunger in operable communication with said plunger, said redundant plunger disposed in said housing, said redundant prime contactor being openable by said redundant plunger, and said redundant adjustment contactor being closable by said redundant plunger.

15. A method of controlling one or more electrical circuits with a limit switch, said limit switch comprises an electrical circuit, said electrical circuit being electrically coupled to a prime contactor and said electrical circuit being electrically coupled to a adjustment contactor, said prime contactor being electrically coupled in series with said adjustment contactor in said electrical circuit, and said limit switch comprises a redundant electrical circuit, said redundant electrical circuit being electrically coupled to a redundant prime contactor and said redundant electrical circuit being electrically coupled to a redundant adjustment contactor, said redundant prime contactor being electrically coupled in series with said redundant adjustment contactor in said redundant electrical circuit said method comprising:

aligning said limit switch in a mid-travel position;

actuating said limit switch by direct acting contact of a plunger against said prime contactor and said redundant prime contactor;

opening said prime contactor to de-energize said electrical circuit;

opening said redundant prime contactor to de-energize said redundant electrical circuit;

closing said prime contactor while said adjustment contactor is closed to energize said electrical circuit;

closing said redundant prime contactor while said redundant adjustment contactor is closed to energize said redundant electrical circuit;

opening said adjustment contactor, when an actuator is misaligned from said plunger, to de-energize said electrical circuit;

opening said redundant adjustment contactor, when an actuator is misaligned from said plunger, to de-energize said redundant electrical circuit.

16. The method of controlling one or more circuits with a limit switch as in claim 15 wherein said actuating said limit switch by direct acting contact includes driving said prime contactor open by said plunger being forced linearly by said actuator, and driving said redundant prime contactor open by said plunger being forced linearly by said actuator.

17. The method of controlling one or more circuits with a limit switch as in claim 16 wherein actuating said limit switch by direct acting contact includes said actuator transferring a rotational motion into a linear motion to said plunger whereby the plunger drives open the prime contactor and the plunger drives open the redundant prime contactor.

18. The method of controlling one or more circuits with a limit switch as in claim 15 wherein said prime contactor having a prime contact plate electrically connectable with prime contact points, said prime contact points being electrically coupled to said electrical circuit; the step of said opening said prime contactor including disconnecting said prime contact plate from said prime contact points, whereby the electrical circuit is de-energized.

19. The method of controlling one or more circuits with a limit switch as in claim 18 wherein the step of disconnecting said prime contact plate from said prime contact points includes driving said prime contact plate open with said plunger activated by said actuator by direct action against a prime spring bias; and connecting said prime contact plate with said prime contact points includes biasing with said prime spring bias said prime contact plate into electrical connection with said prime contact points.

20. The method of controlling one or more circuits with a limit switch as in claim 15 wherein said adjustment contactor includes a adjustment contact plate electrically connectable with adjustment contact points, said adjustment contact points being electrically coupled in series with said prime contactor in said electrical circuit; the step of said opening said adjustment contactor including disconnecting said adjustment contact plate from said adjustment contact points, whereby the electrical circuit is de-energized.

21. The method of controlling one or more circuits with a limit switch as in claim 20 wherein the step of disconnecting said adjustment contact plate from said adjustment contact points includes biasing with an adjustment spring bias said adjustment contact plate breaking electrical connection with said adjustment contact points; and connecting said adjustment contact plate with said adjustment contact points includes driving said plunger coupled to said adjustment contact plate against said adjustment spring bias until said adjustment contact plate electrically connects with said adjustment contact points.

22. The method of controlling one or more circuits with a limit switch as in claim 15 wherein said redundant prime contactor having a redundant prime contact plate electrically connectable with redundant prime contact points, said redundant prime contact points being electrically coupled to said redundant electrical circuit; the step of said opening said redundant prime contactor including disconnecting said redundant prime contact plate from said redundant prime contact points, whereby the redundant electrical circuit is de-energized.

23. The method of controlling one or more circuits with a limit switch as in claim 22 wherein the step of disconnecting said redundant prime contact plate from said redundant prime contact points includes driving said redundant prime contact plate open with said plunger activated by said actuator by direct action against a redundant prime spring bias; and connecting said redundant prime contact plate with said redundant prime contact points includes biasing with said redundant prime spring bias said redundant prime contact plate into electrical connection with said redundant prime contact points.

24. The method of controlling one or more circuits with a limit switch as in claim 15 wherein said redundant adjustment contactor includes a redundant adjustment contact plate electrically connectable with redundant adjustment contact points, said redundant adjustment contact points being electrically coupled in series with said redundant prime contactor in said redundant electrical circuit; the step of said opening said redundant adjustment contactor including disconnecting said redundant adjustment contact plate from said redundant adjustment contact points, whereby the redundant electrical circuit is de-energized.

25. The method of controlling one or more circuits with a limit switch as in claim 24 wherein the step of disconnecting said redundant adjustment contact plate from said redundant adjustment contact points includes biasing with a redundant adjustment spring bias said redundant adjustment contact plate breaking electrical connection with said redundant adjustment contact points; and connecting said redundant adjustment contact plate with said redundant adjustment contact points includes driving said plunger coupled to said redundant adjustment contact plate against said redundant adjustment spring bias until said redundant adjustment contact plate electrically connects with said redundant adjustment contact points.

* * * * *